US006446926B1

(12) United States Patent
Kaschuk

(10) Patent No.: US 6,446,926 B1
(45) Date of Patent: Sep. 10, 2002

(54) SMOKE ALARM RETAINING APPARATUS

(76) Inventor: Thomas J. Kaschuk, # 11 Deerhurst Avenue, Toronto Ontario (CA), M9N 3A4

( * ) Notice: Subject to any disclaimer, the term of this patent is extended or adjusted under 35 U.S.C. 154(b) by 0 days.

(21) Appl. No.: 09/770,371

(22) Filed: Jan. 26, 2001

(51) Int. Cl.[7] ..... E04G 3/00; G08B 17/10; A47H 1/10

(52) U.S. Cl. ..... 248/291.1; 248/317; 340/628

(58) Field of Search ..... 248/291.1, 918, 248/694, 286.1, 317, 320, 323, 324, 327; 340/693.5, 693.6, 628

(56) References Cited

U.S. PATENT DOCUMENTS 4,862,147 A * 8/1989 Thomas ..... 128/201.23
4,881,063 A * 11/1989 Fawcett ..... 116/303
5,053,752 A * 10/1991 Epstein et al. ..... 116/278
5,191,855 A * 3/1993 Conforti ..... 116/200
5,646,598 A * 7/1997 Nickles et al. ..... 340/628
6,114,967 A * 9/2000 Yousif ..... 200/61.45 R

* cited by examiner

*Primary Examiner*—Anita King

(57) ABSTRACT

A smoke alarm retaining apparatus for making a smoke alarm easily reachable for servicing and testing. The smoke alarm retaining apparatus includes a base assembly that is adapted for coupling to a surface. An arm assembly is pivotally coupled to the base assembly such that the arm assembly is selectively positionable in a coplanar relationship with the base assembly. A smoke detector is coupled to the arm assembly such that the arm assembly is selectively positionable in an angular relationship to the base assembly for facilitating positioning of the smoke detector whereby the arm assembly is adapted for facilitating access to the smoke detector.

14 Claims, 2 Drawing Sheets

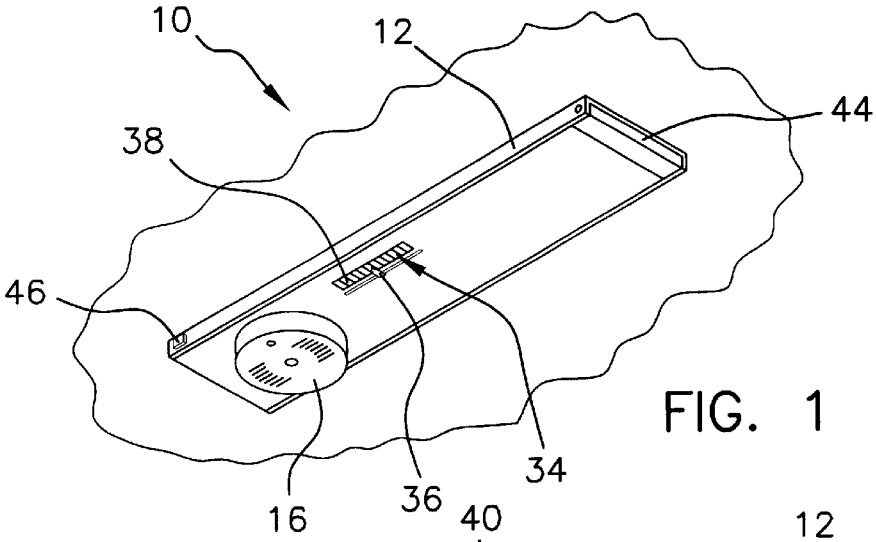
FIG. 1
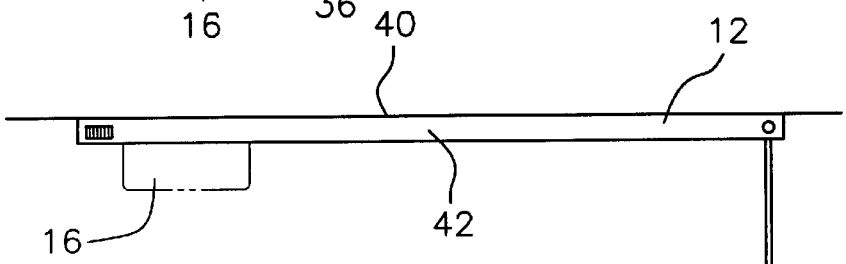
FIG. 2
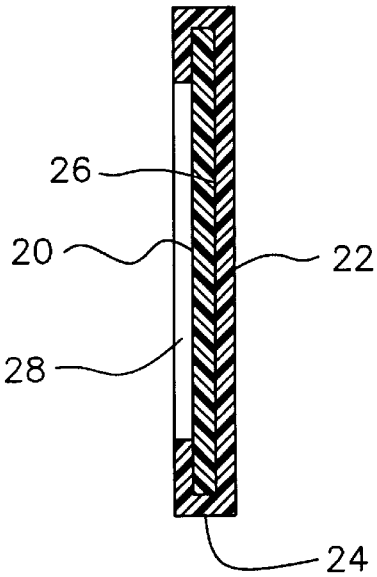
FIG. 3
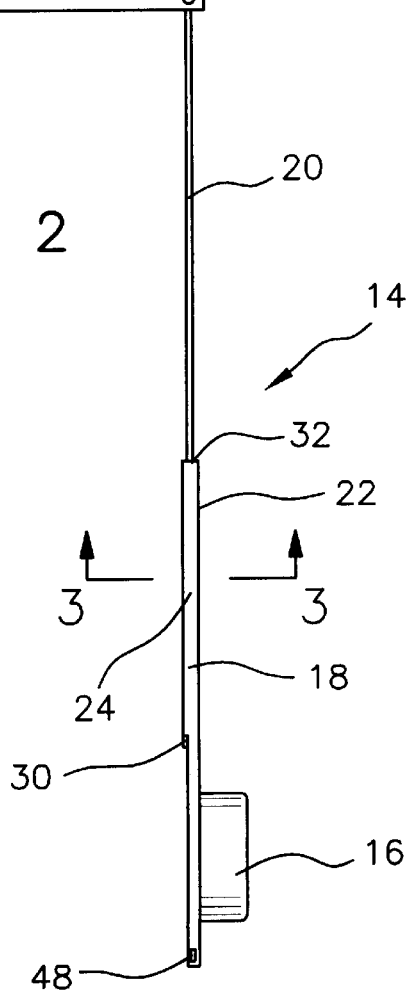

SMOKE ALARM RETAINING APPARATUS

BACKGROUND OF THE INVENTION

1. Field of the Invention

The present invention relates to smoke alarm retaining apparatuses and more particularly pertains to a new smoke alarm retaining apparatus for making a smoke alarm easily reachable for servicing and testing.

2. Description of the Prior Art

The use of smoke alarm retaining apparatuses is known in the prior art. More specifically, smoke alarm retaining apparatuses heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,594,422; 5,149,038; 4,222,093; 4,782,435; 5,130,914; and U.S. Pat. No. Des. 270,689.

While these devices fulfill their respective, particular objectives and requirements, the aforementioned patents do not disclose a new smoke alarm retaining apparatus. The inventive device includes a base assembly that is adapted for coupling to a surface. An arm assembly is pivotally coupled to the base assembly such that the arm assembly is selectively positionable in a coplanar relationship with the base assembly. A smoke detector is coupled to the arm assembly such that the arm assembly is selectively positionable in an angular relationship to the base assembly for facilitating positioning of the smoke detector whereby the arm assembly is adapted for facilitating access to the smoke detector.

In these respects, the smoke alarm retaining apparatus according to the present invention substantially departs from the conventional concepts and designs of the prior art, and in so doing provides an apparatus primarily developed for the purpose of making a smoke alarm easily reachable for servicing and testing.

SUMMARY OF THE INVENTION

In view of the foregoing disadvantages inherent in the known types of smoke alarm retaining apparatuses now present in the prior art, the present invention provides a new smoke alarm retaining apparatus construction wherein the same can be utilized for making a smoke alarm easily reachable for servicing and testing.

The general purpose of the present invention, which will be described subsequently in greater detail, is to provide a new smoke alarm retaining apparatus apparatus and method which has many of the advantages of the smoke alarm retaining apparatuses mentioned heretofore and many novel features that result in a new smoke alarm retaining apparatus which is not anticipated, rendered obvious, suggested, or even implied by any of the prior art smoke alarm retaining apparatuses, either alone or in any combination thereof.

To attain this, the present invention generally comprises a base assembly that is adapted for coupling to a surface. An arm assembly is pivotally coupled to the base assembly such that the arm assembly is selectively positionable in a coplanar relationship with the base assembly. A smoke detector is coupled to the arm assembly such that the arm assembly is selectively positionable in an angular relationship to the base assembly for facilitating positioning of the smoke detector whereby the arm assembly is adapted for facilitating access to the smoke detector.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new smoke alarm retaining apparatus apparatus and method which has many of the advantages of the smoke alarm retaining apparatuses mentioned heretofore and many novel features that result in a new smoke alarm retaining apparatus which is not anticipated, rendered obvious, suggested, or even implied by any of the prior art smoke alarm retaining apparatuses, either alone or in any combination thereof.

It is another object of the present invention to provide a new smoke alarm retaining apparatus, which may be easily and efficiently manufactured and marketed.

It is a further object of the present invention to provide a new smoke alarm retaining apparatus, which is of a durable and reliable construction.

An even further object of the present invention is to provide a new smoke alarm retaining apparatus which is susceptible of a low cost of manufacture with regard to both materials and labor, and which accordingly is then susceptible of low prices of sale to the consuming public, thereby making such smoke alarm retaining apparatus economically available to the buying public.

Still yet another object of the present invention is to provide a new smoke alarm retaining apparatus which provides in the apparatuses and methods of the prior art some of the advantages thereof, while simultaneously overcoming some of the disadvantages normally associated therewith.

Still another object of the present invention is to provide a new smoke alarm retaining apparatus for making a smoke alarm easily reachable for servicing and testing.

Yet another object of the present invention is to provide a new smoke alarm retaining apparatus which includes a base assembly that is adapted for coupling to a surface. An arm assembly is pivotally coupled to the base assembly such that the arm assembly is selectively positionable in a coplanar relationship with the base assembly. A smoke detector is coupled to the arm assembly such that the arm assembly is selectively positionable in an angular relationship to the base assembly for facilitating positioning of the smoke detector whereby the arm assembly is adapted for facilitating access to the smoke detector.

Still yet another object of the present invention is to provide a new smoke alarm retaining apparatus that would allow the smoke detector to be lowered about 2 feet below the surface of the ceiling. This would permit a user to test and replace the battery with a fraction of the effort normally required.

Even still another object of the present invention is to provide a new smoke alarm retaining apparatus that would allow a user to combine the present invention with an existing smoke detector to obtain the same ease of use.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of a new smoke alarm retaining apparatus according to the present invention.

FIG. 2 is a side view of the present invention.

FIG. 3 is a schematic cross-sectional view of the present invention.

DESCRIPTION OF THE PREFERRED EMBODIMENT

Figure 4:
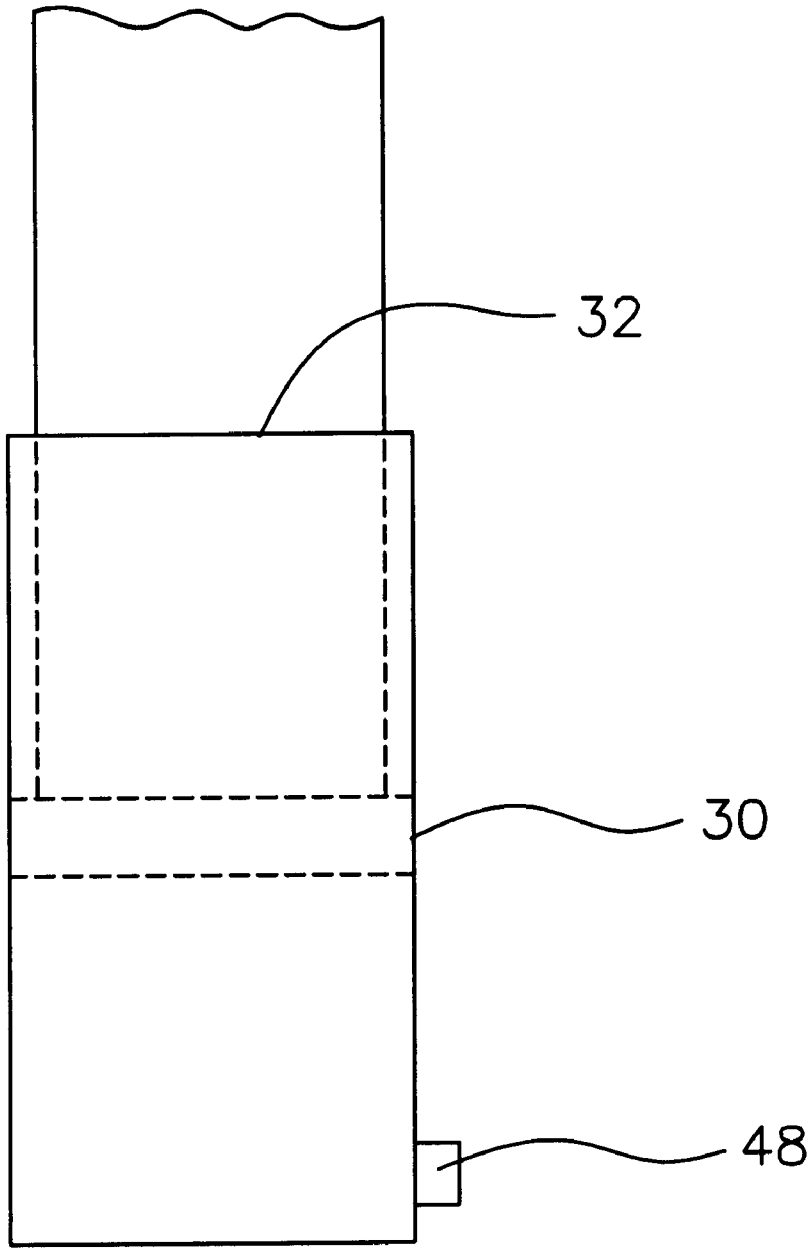
FIG. 4 is a top view of the present invention.

With reference now to the drawings, and in particular to FIGS. 1 through 4 thereof, a new smoke alarm retaining apparatus embodying the principles and concepts of the present invention and generally designated by the reference numeral 10 will be described.

As best illustrated in FIGS. 1 through 4, the smoke alarm retaining apparatus 10 generally comprises a base assembly 12 that is adapted for coupling to a surface. An arm assembly 14 is pivotally coupled to the base assembly 12 such that the arm assembly 14 is selectively positionable in a coplanar relationship with the base assembly 12. A smoke detector 16 is coupled to the arm assembly 14 such that the arm assembly 14 is selectively positionable in an angular relationship to the base assembly 12 for facilitating positioning of the smoke detector 16 whereby the arm assembly 14 is adapted for facilitating access to the smoke detector 16.

The arm assembly 14 includes a first arm 18 and a second arm 20. The first arm 18 is for slidably receiving the second arm 20 such that the first arm 18 is selectively extendable from the second arm 20. The second arm 20 is pivotably coupled to the base assembly 12, the smoke detector 16 is coupled to the first arm 18. The first arm 18 includes an outer wall 22, a pair of side walls 24 and an inner wall 26 such that the outer wall 22, the pair of side walls 24 and the inner wall 26 define a slot 28. The slot 28 is for slidably receiving the second arm 20 such that the slot 28 permits the first arm 18 to be slidably positioned along a length of the second arm 20. The second arm 20 includes a pair of tabs 30 that outwardly extend from opposite sides of the second arm 20 such that the tabs 30 are for engaging a stop wall 32 of the first arm 18 whereby the second arm 20 is prevented from sliding free of the slot 28 of the first arm 18.

The arm assembly 14 includes a reminder assembly 34, which includes a pointer 36 and a plurality of reminder indicia 38 such that the pointer 36 is slidably situated proximate the plurality of indicia 38 whereby the pointer 36 is for indicating one of the indicia 38. The reminder indicia 38 being designed for facilitating reminding a user when a battery was last replaced in the smoke detector 16.

The base assembly 12 includes a top wall 40 and a pair of edge walls 42 downwardly that extend from the top wall 40. The top wall 40 and the pair of edge walls 42 definines a channel 44 for receiving the arm assembly 14 between the pair of edge walls 42. The base assembly 12 includes a switch 46 for releasably engaging a locking tab 48 of the arm assembly 14 such that the switch 46 is actuatable for releasing the arm assembly 14 whereby the arm assembly 14 pivots away from base assembly 12. The locking tab 48 outwardly extends from one of the side walls 24 of the first arm 18, the switch 46 being mounted to one of the edge walls 42 of the base assembly 12 such that the switch 46 is readily accessible by a user.

In use, a user would mount the present invention just like a conventional smoke detector. When the detector needs to be serviced a user would push the spring-loaded latch and the present invention would extend to a retracted position to be easily worked on.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A smoke alarm retaining apparatus comprising:

a base assembly being adapted for coupling to a surface;

an arm assembly being pivotally coupled to said base assembly such that said arm assembly is selectively positionable in a coplanar relationship with said base assembly;

a smoke detector being coupled to said arm assembly such that said arm assembly is selectively positionable in an angular relationship to said base assembly for facilitating positioning of said smoke detector whereby said arm assembly is adapted for facilitating access to said smoke detector; and said arm assembly having a first arm and a second arm, said first arm being for slidably receiving said second arm such that said first arm is selectively extendable from said second arm, said second arm being pivotably coupled to said base assembly, said smoke detector being coupled to said first arm.

2. The smoke alarm retaining apparatus as set forth in claim 1, wherein said first arm has an outer wall, a pair of side walls and an inner wall such that said outer wall, said pair of side walls and said inner wall define a slot, said slot being for slidably receiving said second arm such that said slot permits said first arm to be slidably positioned along a length of said second arm, said second arm having a pair of tabs outwardly extending from opposite sides of said second arm such that said tabs are for engaging a stop wall of said first arm whereby said second arm is prevented from sliding free of said slot of said first arm.

3. The smoke alarm retaining apparatus as set forth in claim 1, wherein said arm assembly has a reminder assembly, said reminder assembly having a pointer and a plurality of reminder indicia such that said pointer is slidably situated proximate said plurality of indicia whereby said pointer is for indicating one of said indicia, said reminder indicia being adapted for facilitating reminding a user when a battery was last replaced in said smoke detector.

4. The smoke alarm retaining apparatus as set forth in claim 1, wherein said base assembly has a top wall and a pair of edge walls downwardly extending from said top wall, said top wall and said pair of edge walls defining a channel for receiving said arm assembly between said pair of edge walls.

5. The smoke alarm retaining apparatus as set forth in claim 4, wherein said base assembly includes a switch for releasably engaging a locking tab of said arm assembly such that said switch is actuable for releasing said arm assembly whereby said arm assembly pivots away from base assembly.

6. The smoke alarm retaining apparatus as set forth in claim 5, wherein said switch is mounted to one of said edge walls of said base assembly such that said switch is readily accessible by a user.

7. The smoke alarm retaining apparatus as set forth in claim 1, further comprising:

said first arm having an outer wall, a pair of side walls and an inner wall such that said outer wall, said pair of side walls and said inner wall define a slot, said slot being for slidably receiving said second arm such that said slot permits said first arm to be slidably positioned along a length of said second arm, said second arm having a pair of tabs outwardly extending from opposite sides of said second arm such that said tabs are for engaging a stop wall of said first arm whereby said second arm is prevented from sliding free of said slot of said first arm;

said arm assembly having a reminder assembly, said reminder assembly having a pointer and a plurality of reminder indicia such that said pointer is slidably situated proximate said plurality of indicia whereby said pointer is for indicating one of said indicia, said reminder indicia being adapted for facilitating reminding a user when a battery was last replaced in said smoke detector;

said base assembly having a top wall and a pair of edge walls downwardly extending from said top wall, said top wall and said pair of edge walls defining a channel for receiving said arm assembly between said pair of edge walls; and said base assembly including a switch for releasably engaging a locking tab of said arm assembly such that said switch is actuatable for releasing said arm assembly whereby said arm assembly pivots away from base assembly, said locking tab outwardly extending from one of said side walls of said first arm, said switch being mounted to one of said edge walls of said base assembly such that said switch is readily accessible by a user.

8. A smoke alarm retaining apparatus comprising:

a base assembly being adapted for coupling to a surface;

an arm assembly being pivotally coupled to said base assembly such that said arm assembly is selectively positionable in a coplanar relationship with said base assembly;

a smoke detector being coupled to said arm assembly such that said arm assembly is selectively positionable in an angular relationship to said base assembly for facilitating positioning of said smoke detector whereby said arm assembly is adapted for facilitating access to said smoke detector; and said arm assembly having a reminder assembly, said reminder assembly having a pointer and a plurality of reminder indicia such that said pointer is slidably situated proximate said plurality of indicia whereby said pointer is for indicating one of said indicia, said reminder indicia being adapted for facilitating reminding a user when a battery was last replaced in said smoke detector.

9. The smoke alarm retaining apparatus as set forth in claim 8, wherein said base assembly has a top wall and a pair of edge walls downwardly extending from said top wall, said top wall and said pair of edge walls defining a channel for receiving said arm assembly between said pair of edge walls.

10. The smoke alarm retaining apparatus as set forth in claim 9, wherein said base assembly includes a switch for releasably engaging a locking tab of said arm assembly such that said switch is actuatable for releasing said arm assembly whereby said arm assembly pivots away from base assembly.

11. The smoke alarm retaining apparatus as set forth in claim 10, wherein said switch is mounted to one of said edge walls of said base assembly such that said switch is readily accessible by a user.

12. A smoke alarm retaining apparatus comprising:

a base assembly being adapted for coupling to a surface;

an arm assembly being pivotally coupled to said base assembly such that said arm assembly is selectively positionable in a coplanar relationship with said base assembly;

a smoke detector being coupled to said arm assembly such that said arm assembly is selectively positionable in an angular relationship to said base assembly for facilitating positioning of said smoke detector whereby said arm assembly is adapted for facilitating access to said smoke detector; and said base assembly having a top wall and a pair of edge walls downwardly extending from said top wall, said top wall and said pair of edge walls defining a channel for receiving said arm assembly between said pair of edge walls.

13. The smoke alarm retaining apparatus as set forth in claim 12, wherein said base assembly includes a switch for releasably engaging a locking tab of said arm assembly such that said switch is actuatable for releasing said arm assembly whereby said arm assembly pivots away from base assembly.

14. The smoke alarm retaining apparatus as set forth in claim 13, wherein said switch is mounted to one of said edge walls of said base assembly such that said switch is readily accessible by a user.

* * * * *